United States Patent [19]

Suematsu et al.

[11] Patent Number: 4,965,180

[45] Date of Patent: Oct. 23, 1990

[54] SILVER HALIDE PHOTOGRAPHIC MATERIAL

[75] Inventors: Koichi Suematsu, Shizuoka; Sumito Yamada, Kanagawa; Tomokazu Yasuda, Kanagawa; Junichi Yamanouchi, Kanagawa; Yasuo Mukunoki, Kanagawa, all of Japan

[73] Assignee: Fujii Photo Film Co., Ltd., Kanagawa, Japan

[21] Appl. No.: 287,292

[22] Filed: Dec. 21, 1988

[30] Foreign Application Priority Data

Dec. 22, 1987 [JP] Japan ..... 62-324575

[51] Int. Cl.[5] ..... G03C 1/80

[52] U.S. Cl. ..... 430/518; 430/536; 430/930; 430/941; 430/966

[58] Field of Search ..... 430/213, 941, 518, 536, 430/966, 930

[56] References Cited

U.S. PATENT DOCUMENTS

| | | | |
|---|---|---|---|
| 4,124,386 | 11/1978 | Yoshida et al. | 430/941 |
| 4,372,194 | 2/1983 | McGuckin et al. | 430/941 |
| 4,600,687 | 7/1986 | Nakamura et al. | 430/941 |
| 4,721,666 | 1/1988 | Yamanuochi et al. | 430/213 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide photographic material which comprises a support having a subbing layer containing an aqueous polymer latex represented by the following formula (I), which has a cross linked structure:

(I)

wherein A represents an ethylenic unsaturated monomer unit; $R_1$ represents a hydrogen atom or a lower alkyl group having from 1 to 6 carbon atoms; L represents a divalent group having from 1 to 12 carbon atoms; $R_2$, $R_3$ and $R_4$, which may be the same or different, each represents an alkyl group, an aralkyl group or a hydrogen atom; Q represents nitrogen or phosphorus; X-represents an anion other than iodine ion; and B represents a structural unit in which copolymerizable monomers having at least two ethylenic unsaturated groups have been copolymerized: x is selected to constituted from 0 to 90 mol%; y is selected to constitute from 10 to 99.9 mol%; z is selected to constitute from 0.1 to 50 mol%; and $R_2$, $R_3$ and $R_4$ may be linked together to form, together with Q, a cyclic structure;

and wherein the subbing layer comprises a coating liquid containing a nonionic surfactant in an amount of at least 0.05 gram per liter.

20 Claims, No Drawings

SILVER HALIDE PHOTOGRAPHIC MATERIAL

FIELD OF THE INVENTION

This invention concerns silver halide photographic materials (referred to below as light-sensitive materials). In particular, this invention concerns light-sensitive materials for photography which have excellent fixing properties and which, when color sensitized, have little residual coloration, and which are eminently suitable for rapid processing at a high film speed. Furthermore, this invention concerns light-sensitive materials for medical photography purposes such as for example X-ray film for direct medical applications, wherein the light-sensitive materials have (1) no residual coloration, (2) a high degree of sharpness, and (3) excellent drying properties, and are suitable for ultra-rapid processing (dry to dry times of 30 to 60 seconds).

BACKGROUND OF THE INVENTION

In the past some shortening of processing time for light-sensitive materials for photography has been achieved as a result of progress relating to light-sensitive materials and processing agents. In general, photographs by amateur or professional, need only to be processed taken quickly enough to suit convenience. However, in the printing field, especially in the case of newspapers etc., information has to be communicated immediately and thus a reduction in processing time of light-sensitive material is clearly desirable. Moreover, in the case of light-sensitive materials which are used in the course of medical treatment, it is necessary in emergencies to make a diagnosis and take action within seconds, and thus here a reduction in processing time is of the greatest importance.

Development time, fixing time, washing time and drying time can be reduced in order to shorten the processing time. Sometimes the activity of the development bath is increased by increasing the concentration of developing agent, increasing the pH, or by raising the processing temperature, while in other cases the development properties of the silver halide emulsions themselves are improved. Such methods are already well known. However, raising the activity of the development bath can result in increased costs and it can result in a reduction in the stability of the development bath itself over a period of time, yet such systems do not always represent an increase in commercial value. On the other hand, the washing time and drying time are largely dependent on the thickness and the degree of swelling of the coated film on of the light-sensitive material. These times can be shortened by increasing the degree of crosslinking of the gelatin with the use of adequate film hardening agents before treatment, but this method reduces the covering power of the silver halide and thus the amount of silver coated may have to be increased or there may be a reduction of sensitivity and a reduction in the rate of development and, moreover, the method results in a lowering of the fixing rate. Thus, even though there are methods available for shortening the processing time for each of these operations, in virtually all cases the method of shortening is accompanied by significant disadvantages.

In direct X-ray photographic films for medical purposes the emulsion layers are generally coated on both sides of the support in order to reduce the level of exposure of the body to harmful X-rays, and considerable amplification is achieved by taking pictures using sensitizing screens on both sides of the light-sensitive material. The problem with such a photography system is known as "crossover". This means that the light which is emitted by a sensitizing screen not only exposes the silver halide emulsion layer on the side adjacent to the screen, but also exposes the emulsion layer on the opposite side with the scattered light which has passed through the emulsion layer and the support. This "crossover" results in an image of reduced sharpness.

On the other hand, techniques for improving sharpness by adding magenta dyes or yellow dyes to ortho type light-sensitive materials have been developed, as described in U.S. Pat. No. 4,130,429 and JP-A-No. 61-116354 and JP-A-No. 61-116349. (the term "JP-A" as used herein refers to an unexamined published Japanese patent application). However, when a dye is simply added to the silver halide emulsion layers it inevitably has the effect of reducing the photographic sensitivity due to optical absorption. Hence, methods in which these dyes are added to intermediate layers between the silver halide emulsion layers and the support have sometimes been adopted in the industry. But, with the provision of just a simple intermediate layer, the dyes diffuse during the coating of the emulsion layers, and thus there is still some loss of photographic sensitivity. Moreover, to make matters even worse, gelatin or some other binder has to be used to coat the intermediate layer, and the increase in the amount of binder used inevitably has an adverse effect on the drying properties of the light-sensitive material.

To overcome the above problems, it has been proposed to use basic polymeric mordants to fix water soluble dyes, which dyes can be decolorized during photographic processing in the subbing layer of the support. Such methods have been disclosed in JP-A-No. 62-70830 and JP-A-No. 55-33172. These methods are very effective toward fulfilling objectives of the present invention, but they fall short because in these methods the subbing layer has a coated gelatin weight of not more than 0.5 g/m$^2$, and when a basic polymeric mordant is coated in a gelatin layer as lightly as this, the surface of the subbing layer becomes irregular. That is, streaks, ladder and comet etc. occur to an intolerable extent. Hence, it is not possible to use the above methods to achieve excellent performance.

SUMMARY OF THE INVENTION

This invention provides light-sensitive materials for photography which (1) yield high photographic performance, (2) have a good undercoated surface, (3) have excellent fixing properties, (4) have little residual coloration after being color sensitized, and (5) are suitable for rapid processing while maintaining a high photographic sensitivity.

More precisely, the objective of the present invention is to provide light-sensitive materials for medical use which provide a high degree of sharpness, yield little residual coloration, and are suitable for ultra-rapid processing.

The above-described objectives of the present invention have been achieved by providing a silver halide photographic material which comprises a support having a subbing layer containing an aqueous polymer latex represented by the following formula (I), which has a cross linked structure:

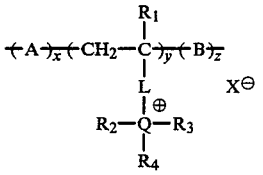

(I)

wherein A represents an ethylenic unsaturated monomer unit; $R_1$ represents a hydrogen atom or a lower alkyl group having from 1 to 6 carbon atoms; L represents a divalent group having from 1 to 12 carbon atoms; $R_2$, $R_3$ and $R_4$, which may be the same or different, each represents an alkyl group, an aralkyl group or a hydrogen atom; Q represents nitrogen or phosphorus; $X^{\ominus}$ represents an anion other than iodine ion; B represents a structural unit in which copolymerizable monomers having at least two ethylenic unsaturated groups have been copolymerized; x is selected to constitute from 0 to 100 mol %; y is selected to constitute from 10 to 99.9 mol %; z is selected to constitute from 0.1 to 50 mol %; and $R_2$, $R_3$ and $R_4$ may be linked together to form, together with Q, a cyclic structure;

and wherein said subbing layer comprises a coating liquid containing a nonionic surfactant in an amount of at least 0.05 gram per liter.

DETAILED DESCRIPTION OF THE INVENTION

Preferably, $R_2$, $R_3$ and $R_4$ each represent the same or different alkyl group which has from 1 to 20 carbon atoms, aralkyl group which has from 7 to 20 carbon atoms or a hydrogen atom. It is more preferable that only one of $R_2$, $R_3$ and $R_4$ should be a hydrogen atom.

Examples of the ethylenic unsaturated monomer of the unit A include olefins (for example, ethylene, propylene, 1-butene, vinyl chloride, vinylidene chloride, isobutene, vinyl bromide, etc.), dienes (for example, butadiene, isoprene, chloroprene, etc.), ethylenic unsaturated esters of fatty acids or aromatic carboxylic acids (for example, vinyl acetate, allyl acetate, vinyl propionate, vinyl butyrate, vinyl benzoate, etc.), esters of ethylenic unsaturated acids (for example, methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, maleic acid dibutyl ester, fumaric acid diethyl ester, ethyl crotonate, methylene malonic acid dibutyl ester, etc.), styrenes (for example, styrene, α-methylstyrene, vinyltoluene, chloromethyl styrene, chlorostyrene, dichlorostyrene, bromostyrene, etc.), and unsaturated nitriles (for example, acrylonitrile, methacrylonitrile, allylcyanide, crotononitrile, etc.). Among these compounds, the use of the styrenes and/or the methacrylic acid esters is especially desirable in view of (i) their emulsion polymerization properties and (ii) their hydrophobic nature. The A units in the polymer can also include two or more types of the above-mentioned monomers.

$R_1$ preferably represents a hydrogen atom or a methyl group from the point of view of the polymer reaction properties.

The preferred L groups are the divalent groups represented by

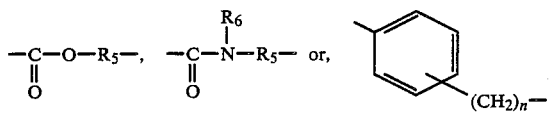

wherein $R_5$ represents an alkylene group (for example, a methylene group, ethylene group, trimethylene group, tetramethylene group, etc.), an arylene group or an aralkylene group (for example, a

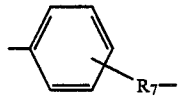

group, wherein $R_7$ represents an group which has from 1 to 6 carbon atoms); $R_6$ represents an alkyl group which has from 1 to 20 carbon atoms, an aralkyl group which has from 7 to 20 carbon atoms or a hydrogen atom; and n is 1 or 2.

Of these,

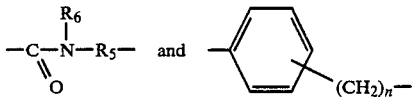

are preferred from the point of view of alkali resistance. The group

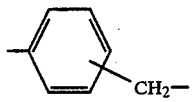

is more preferred from the viewpoint of the emulsion polymerization properties, etc.

Q in formula (I) is preferably a nitrogen atom, from the viewpoint of the toxicity of the raw material.

$X^{\ominus}$ in formula (I), which is an anion other than iodine ion, is preferably a halogen ion (such as a chlorine ion, bromine ion, etc.), an alkylsulfate ion (such as a methylsulfate ion, ethylsulfate ion, etc.), an alkyl or arylsulfonic acid ion (such as a methanesulfonate ion, ethanesulfonate ion, benzenesulfonate ion, p-toluenesulfonate ion, etc.), a nitrate ion, an acetate ion, or a sulfate ion, etc. Of these, a chlorine ion, an alkylsulfate ion, an arylsulfonate ion and a sulfate ion are especially preferred.

The alkyl groups and aralkyl groups of $R_2$, $R_3$ and $R_4$ include the substituted alkyl groups and substituted aralkyl groups.

The alkyl groups may be unsubstituted alkyl groups, for example, methyl group, ethyl group, propyl group, iso-propyl group, t-butyl group, hexyl group, cyclohexyl group, 2-ethylhexyl group, dodecyl group etc., or substituted alkyl groups, for example, alkoxyalkyl groups (such as methoxymethyl group, methoxybutyl group, ethoxyethyl group, butoxyethyl group, vinyloxyethyl group, etc.), cyanoalkyl groups (such as 2-cyanoethyl group, 3-cyanopropyl group, etc.), haloalkyl groups (such as 2-fluoroethyl group, 2-chloroethyl group, perfluoropropyl group, etc.), alkoxycarbonylalkyl groups (such as ethoxycarbonylmethyl group, etc.), allyl group, 2-butenyl group, propargyl group, etc.

The aralkyl groups may be substituted aralkyl groups, for example, benzyl group, phenethyl group, diphenylmethyl group, naphthylmethyl group, etc., or substituted aralkyl groups, for example alkylaralkyl groups (such as 4-methylbenzyl group, 2,5-dimethylbenzyl group, 4-isopropylbenzyl group, 4-octylbenzyl group, etc.), alkoxyaralkyl groups (such as 4-methoxybenzyl group, 4-pentafluoropropenyloxybenzyl group, 4-ethoxybenzyl group, etc.), cyanoaralkyl groups (such as 4-cyanobenzyl group, 4-(4 cyanophenyl)benzyl group, etc.), or haloaralkyl groups (such as 4-chlorobenzyl group, 3-chlorobenzyl group, 4-bromobenzyl group, 4-(4chlorophenyl)benzyl group, etc.).

The alkyl groups represented by $R_2$, $R_3$, and $R_4$ in formula (I) more preferably have from 1 to 12 carbon atoms and the aralkyl groups more preferably have from 7 to 14 carbon atoms.

In formula (I), y preferably is from 10 to 95 mol %, and z preferably is from 1 to 30 mol %.

B represents a structural unit in which copolymerizable monomers having at least two ethylenic unsaturated groups have been copolymerized. Examples of B include ethyleneglycol dimethacrylate, diethyleneglycol dimethacrylate, neopentylglycol dimethacrylate, tetramethyleneglycol dimethacrylate, pentaerythritol tetramethacrylate, trimethylolpropane trimethacrylate, ethyleneglycol diacrylate, diethyleneglycol diacrylate, neopentylglycol diacrylate, tetramethyleneglycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylenediammonium dichloride, N,N'-bis(vinylbenzyl)triethylenediammonium dichloride, N,N,N',N'-tetrabutyl-N,N'-bis(vinylbenzyl)ethylenediammonium dichloride, etc. Of these compounds, the use of divinyl benzene and trivinylcyclohexane is especially preferred from the viewpoint of hydrophobic properties and alkali resistance.

The following compounds are illustrative of formula (I), but the present invention is not to be construed as being limited thereto. In the following compounds, ratios of x, y and z are represented by mol.

(I-1)

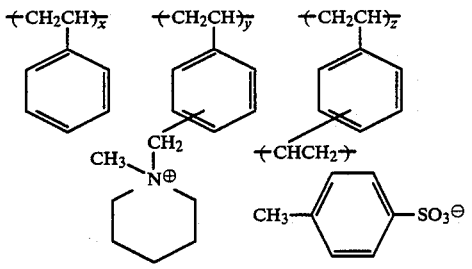

x:y:z = 47.5:47.5:5

-continued (I-2)

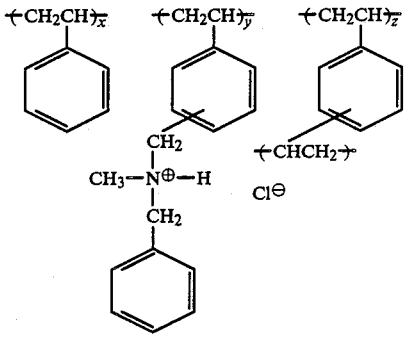

x:y:z = 45:45:10

(I-3)

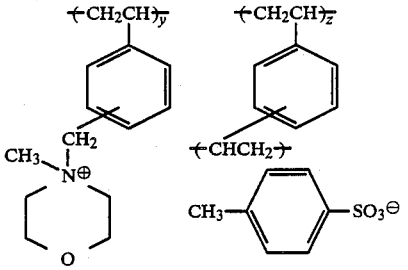

y:z = 95:5

(I-4)

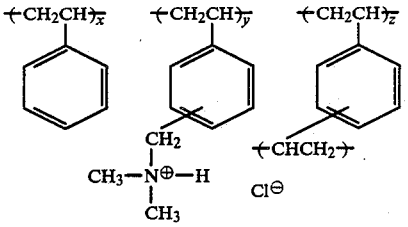

x:y:z = 45:45:10

(I-5)

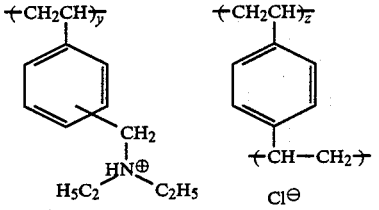

y:z = 80:20

(I-6)

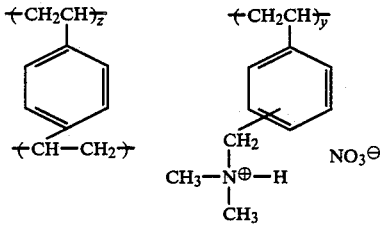

y:z = 50:50

The amount of the polymer latex added is from 5 to 300 mg/m$^2$, and preferably from 10 to 100 mg/m$^2$, in a single subbing layer.

The nonionic surfactants used in the invention fulfill the role of maintaining a good surface state on the subbing layer which contains the aqueous polymer latex.

The nonionic surfactant can be selected from the compounds known in the industry.

The amount of nonionic surfactant in the coating liquid is from 0.05 to 10 grams, and preferably from 0.05 to 1 gram, per liter of coating liquid.

The amount of nonionic surfactant is present in the subbing layer in an amount of from 0.1 to 50 mg/m$^2$, preferably from 0.5 to 20 mg/m$^2$, of the subbing layer.

Actual examples of nonionic surfactants which are preferably used in the present invention are indicated below, but the present invention is not to be construed as being limited thereto.

$C_{11}H_{23}COO(CH_2CH_2O)_8H$ II-1

$C_{15}H_{31}COO(CH_2CH_2O)_{15}H$ II-2

$C_{17}H_{33}COO(CH_2CH_2O)_5(CH_2CH(OH)CH_2)_3(CH_2CH_2O)_5H$ II-3

$C_8H_{17}O(CH_2CH_2O)_7H$ II-4

$C_{12}H_{25}O(CH_2CH_2O)_{10}H$ II-5

$C_{16}H_{33}O(CH_2CH_2O)_{12}H$ II-6

$C_{18}H_{35}O(CH_2CH(OH)CH_2O)_2(CH_2CH_2O)_{10}H$ II-7

$C_{22}H_{45}O(CH_2CH_2O)_{25}H$ II-8

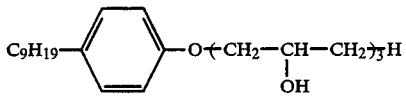
II-9

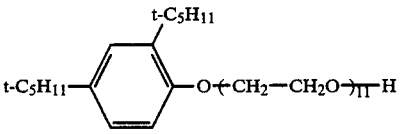
II-10

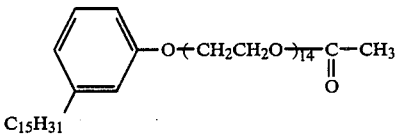
II-11

$C_{16}H_{33}O(CH_2CH_2O)_4(CH_2CH(OH)CH_2)_2(CH_2CH_2O)_4H$ II-12

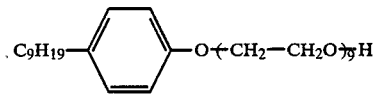
II-13

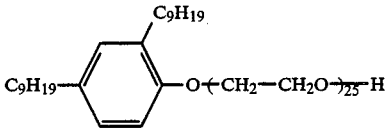
II-14

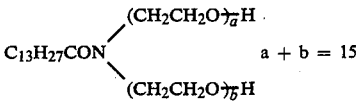
II-15

-continued

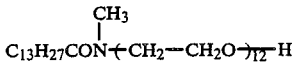
II-16

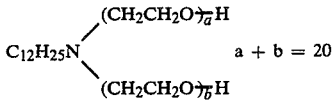
II-17

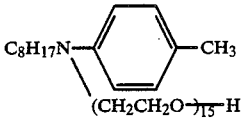
II-18

$C_{12}H_{25}S(CH_2CH_2O)_{16}H$ II-19

$C_{12}H_{25}O(CH(CH_3)CH_2O)_3(CH_2CH_2O)_{15}H$ II-20

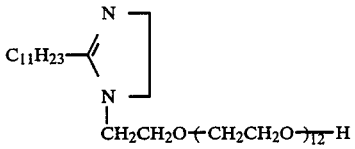
II-21

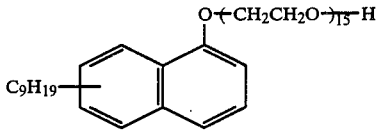
II-22

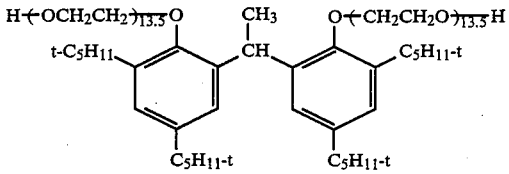
II-23

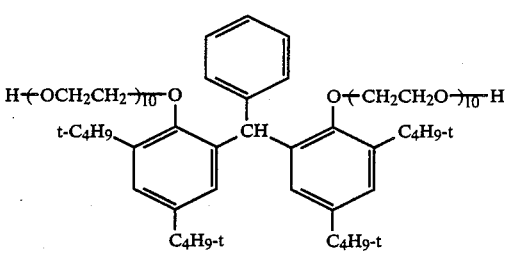
II-24

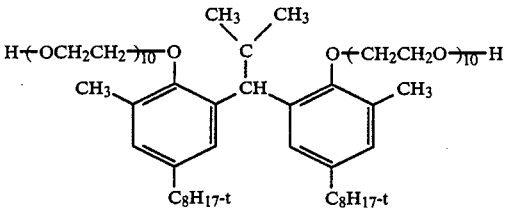
II-25

Of these nonionic surfactants, the compounds which can be represented by the formulae (A) and (B) below are preferred because they have a good surface improving effect when used in this invention.

Those compounds of general formula (A) are known to have an adhesion improving effect, according the JP-A-No. 62-231253:

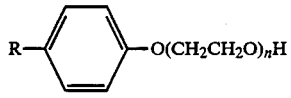

(A)

$R-O(CH_2CH_2O)_nH$ (B)

wherein R represents a substituted or unsubstituted alkyl group having from 1 to 30 carbon atoms, preferably from 3 to 22 carbon atoms; and n has a value of at least 5 but not more than 50, and preferably of at least 7 but not more than 40.

The substituents for the substituted alkyl group of R include a halogen group and a hydroxy group.

Compounds of formulae (A) and (B) which are useful in the invention are indicated below, but the present invention is not to be construed as being limited thereto.

| | | |
|---|---|---|
| (II-26) | 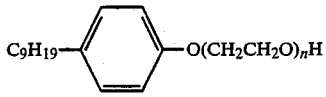 | n = 8.5 |
| (II-27) | 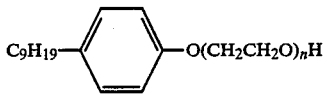 | n = 15 |
| (II-28) | 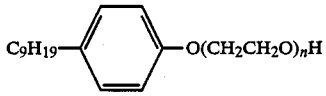 | n = 20 |
| (II-29) | 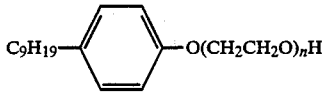 | n = 30 |
| (II-30) | 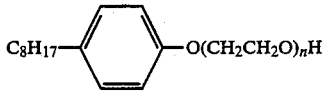 | n = 10 |
| (II-31) | $C_{12}H_{25}O(CH_2CH_2O)_nH$ | n = 10 |
| (II-32) | $C_{12}H_{25}O(CH_2CH_2O)_nH$ | n = 15 |
| (II-33) | $C_8H_{17}O(CH_2CH_2O)_nH$ | n = 10 |
| (II-34) | $C_8H_{17}O(CH_2CH_2O)_nH$ | n = 18 |

The methods which can be used for coating the subbing layer include the so-called lamination method in which a layer which is well bonded to the support is provided, and a hydrophilic resin is coated over this layer as a second layer as disclosed in JP-A-No. 52-49019, JP-A-No. 52-42114 and JP-A-No. 52-104913. Also included is the method in which just a single resin layer which contains both hydrophobic groups and hydrophilic groups is coated as disclosed in JP-B-No. 47-24270 (the term "JP-B" as used herein refers to an examined Japanese patent publication) and JP-A-No. 51-30274. Either of these methods can be employed effectively in this invention but the lamination method has a more desirable effect.

Moreover, surface treatment of the support prior to coating the subbing layer, as disclosed in JP-A-No. 52-114670 also has a beneficial effect in this invention. Known methods of surface treatment which can be used include chemical treatments, mechanical treatments, coronal discharge treatments, flame treatments, treatment with ultraviolet radiation, high frequency treatments, glow discharge treatments, active plasma treatments, laser treatments, mixed acid treatments, ozone oxidation treatments, etc.

Further improvement in the surface condition of the subbing layer can be achieved by using a betaine surfactant (for example, $C_{11}H_{23}CONHCH_2CH_2CH\overset{+}{N}(CH_3)_2COO^-$, etc.) conjointly with a nonionic surfactant in a subbing layer of this invention. In this case, the amount of the betaine surfactant in the subbing layer is preferably 1 to 50 mg/m$^2$, more preferably 1 to 20 mg/m$^2$.

Moreover, the method in which a water soluble methylcellulose is included in the subbing layer as disclosed in JP-A-No. 60-26944 is especially useful in this invention. The methyl cellulose may be included at a rate of from 1% to 99%, preferably at a rate of from 2% to 50%, and most desirably at a rate of from 3% to 30%, in terms of weight with respect to the weight of binder (gelatin).

The use of methylcellulose with a degree of substitution of from 0 to 2.5, preferably of from 0.5 to 2.5, and most preferably of from 1.0 to 2.5, has an excellent effect. The degree of polymerization of the methylcellulose can be selected arbitrarily with respect to the relationship with the viscosity according to method of coating.

The polymers of this invention can be used effectively as substances which mordant anti-halation and anti-irradiation dyes. In this case the dye used is preferably one of the anionic type which is decolorized in the development fixing washing process. Moreover, it is possible to cut-out crossover light and to improve sharpness by mordanting a decolorizable dye in double sided direct X-ray films for medical purposes. Furthermore, the addition of anionic dyes to the subbing layers of this invention has a particularly desirable effect.

Preferred dyes which can be used in the invention are described below, but the present invention is not to be construed as being limited thereto.

Thus dyes of this type include, for example, the oxonol dyes which have a pyrazolone nucleus or barbituric acid nucleus as disclosed in British Pat. Nos. 506,385, 1,177,429, 1,311,884, 1,338,799, 1,385,371, 1,467,214, 1,433,102 and 1,553,516, in JP-A-No. 48-85130, JP-A-No. 49-114420, JP-A-No. 52-117123, JP-A-No. 55-161233 and JP-A-No. 59-111640, in JP-B-No. 39-22069 and JP-B-No. 43-13168 and in U.S. Pat. Nos. 3,274,127, 3,469,985 and 4,078,933, etc., the other oxonol dyes disclosed in U.S. Pat. Nos. 2,533,472 and 3,379,533 and in British Pat. No. 1,278,621, etc., the azo dyes disclosed in British Pat. Nos. 575,691, 680,631, 599,623, 786,907, 907,125 and 1,045,609, in U.S. Pat. No. 4,255,326, and JP-A-No. 59-211043, etc., the azomethine dyes disclosed in JP-A-No. 50-100116 and JP-A-No. 54-118247, and in British Pat. Nos. 2.014,598 and 750,031, the anthraquinone dyes disclosed in U.S. Pat. No. 2,865,752, the arylidene dyes disclosed in U.S. Pat. Nos. 2,538,009, 2,688,541 and 2,538,008, in British Pat. Nos. 584,609 and 1,210,252, in JP-A-No. 50-40625, JP-A-No. 51-3623, JP-A-No. 51-10927 and JP-A-No. 54-118247, and in JP-B-No. 48-3286 and JP-B-No. 59-37303, etc., the styryl dyes disclosed in JP-B-No.

28-3082, JP-B-No. 44-16594 and JP-B-No. 59-28898, etc., the triarylmethane dyes disclosed in British Pat. Nos. 446,583 and 1,335,422, and in JP-A-No. 59-228250, the merocyanine dyes disclosed in British Pat. Nos. 1,075,653, 1,153,341, 1,284,730, 1,475,228 and 1,542,807, etc., and the cyanine dyes disclosed in U.S. Pat. Nos. 2,843,486 and 3,294,539, etc.
Typical dyes are indicated below, but the invention is not to be construed as being limited to these dyes.
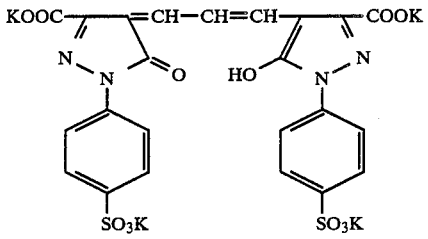
III-1
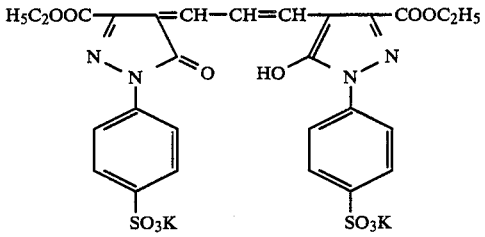
III-2
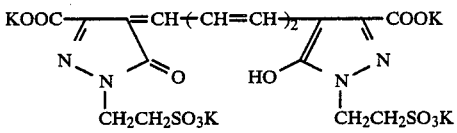
III-3
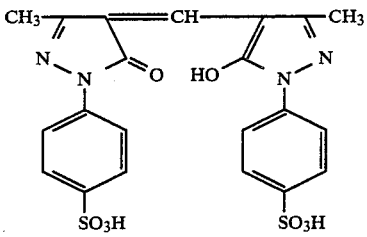
III-4
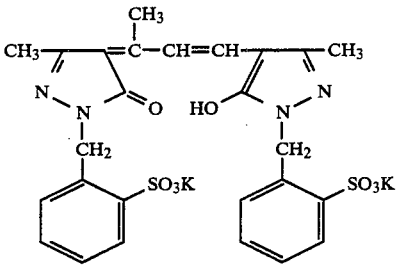
III-5
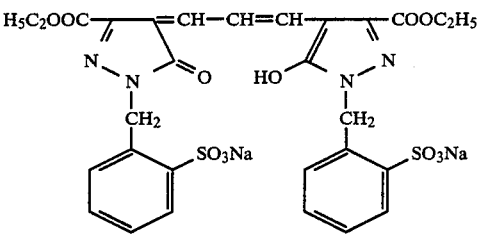
III-6

-continued
III-7
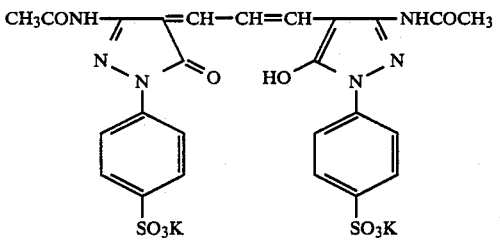
III-8
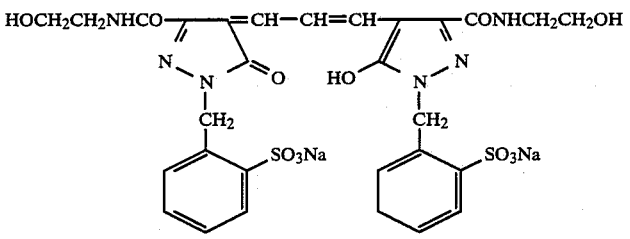
III-9
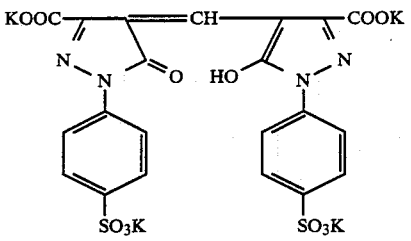
III-10
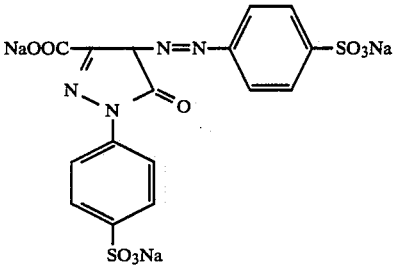
III-11
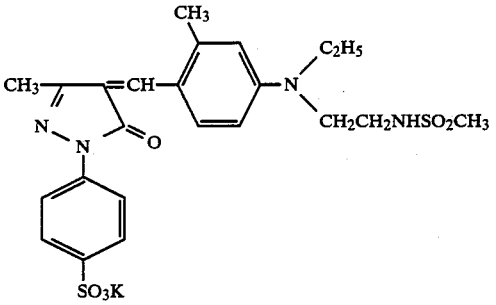
III-12
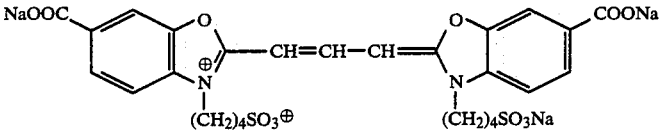

-continued

III-13

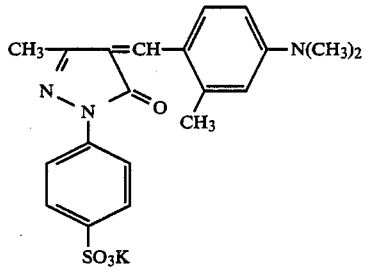

III-14

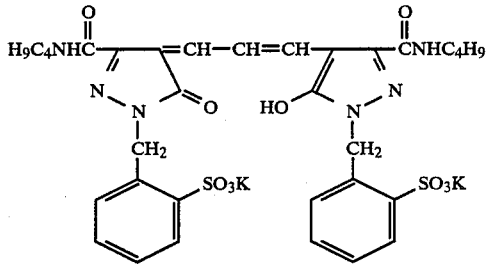

Any of the known methods of black and white photographic processing and the known processing baths as disclosed, for example, in *Research Disclosure* No. 176, RD-17643, pages 38 to 39 (December, 1978) can be used for the photographic processing of the light-sensitive materials of this invention. A processing temperature of from 18° C. to 50° C. is normally selected, but temperatures below 18° C. and temperatures in excess of 50° C. can be used. However, the use of rapid processing in automatic developing machines at temperatures of from 30° C. to 45° C. is especially desirable in this invention.

In the case of light-sensitive materials for medical photography purposes, a dry to dry processing time of from 30 to 120 seconds, preferably of from 30 to 90 seconds, is desirable. In the case of industrial X-ray light-sensitive materials a dry to dry time of not more than 5 minutes, preferably of from 3 to 5 minutes, is desirable.

The known developing agents can be included in the development baths and light-sensitive materials which are used for black and white photographic processing. Thus, dihydroxybenzenes (for example, hydroquinone), 3-pyrazolidones (for example, 1-phenyl-3-pyrazolidone), aminophenols (for example, N-methyl-p-aminophenol) etc. can be used either individually or in combination. In general, other known additives such as preservatives, alkalis, pH buffers, anti-foggants, etc. are included in the development bath, and solution promotors, toning agents, development accelerators (for example, quaternary salts, hydrazine, benzyl alcohol), surfactants, defoaming agents, hard water softening agents, film hardening agents (for example, glutaraldehyde) and viscosity imparting agents etc. can also be included, as required, in the development bath.

The methods in which a developing agent is included in the light-sensitive material, for example, in the emulsion layer, and in which the light-sensitive material is developed by treatment in an aqueous alkali solution can be used as a special form of development processing. The developing agents which are hydrophobic can be included in an emulsion layer using the various methods which have been described in *Research Disclosure* No. 169, RD-16928 (May, 1978), in U.S. Pat. No. 2,739,890, British Patent No. 813,253 or West German Patent No. 1,547,763, etc. Development processing of this type can be combined with a silver salt stabilization treatment using thiocyanate.

The compositions in general use as fixing baths can be employed in the present invention for that purpose. The organic sulfur compounds which are known to be effective as fixing agents as well as thiosulfates and thiocyanates can be used as the fixing agent. Water soluble aluminum salts can also be included in the fixing bath as film hardening agents. The fixing process time is not more than 15 seconds, preferably not more than 10 seconds and most preferably not more than 7 seconds.

Silver chloride, silver chlorobromide, silver bromide, silver iodobromide and silver chloroiodobromide can be used for the light-sensitive silver halide emulsion which is used in the present invention, but the use of silver bromide or silver iodobromide is preferred from the viewpoint of high sensitivity. In particular, the silver halide emulsion having an iodide content of from 0 to 3.5 mol % is preferably used in the present invention.

The use of silver iodobromide grains which have a structure in which the interior consists of a high iodide content phase is especially preferable.

Furthermore, compounds of the type which release an inhibitor during development, as disclosed in JP-A-Nos. 61-230135 and 63-25653, can additionally be used in the present invention.

In the case of light-sensitive materials for medical photography purposes, the amount of silver coated on the light-sensitive materials of this invention is from 1.0 to 6.0 g/m$^2$, preferably from 1.0 to 3.0 g/m$^2$, per side of the support. On the other hand, in the case of industrial X-ray light-sensitive materials, a coating of from 6 to 15 g/m$^2$ on one side of the support is preferred.

The average grain size of corresponding spheres of the same volume as the grains is preferably at least 0.3 μm. An average grain size of from 0.3 to 2.0 μm is especially preferred. The grain size distribution may be narrow or wide.

The silver halide grains in the emulsion may have a regular crystalline form, such as a cubic or octahedral form, an irregular form, such as a spherical, plate-like or potato shaped form, or they may have a complex form comprising more than one of these crystal forms, or they may consist of a mixture of grains which have various crystalline forms.

The use of tabular grains for the silver halide grains which are used in the invention is especially effective.

Tabular silver halide grains can be manufactured using a suitable combination of the methods known in the industry.

Tabular silver halide emulsions have been described by Cugnac and Chateau in *Evolution of the Morphology of the Silver Bromide Crystals during Physical Ripening,* Science et Industrie Photographie, Vol. 33, No. 2 (1962), pages 121 to 125; by Duffin in *Photographic Emulsion Chemistry,* Focal Press, New York, 1966, pages 66 to 72; and by A. P. H. Trivelli and W. F. Smith, *Photographic Journal,* Vol. 80, page 285 (1940) etc. In addition, tabular silver halide emulsions can be prepared easily with reference to the methods disclosed in JP-A Nos. 58-127921, 58-113927 and 58-113928 and in U.S. Pat. No. 4,439,520, etc. The tabular grain emulsions preferably used in this invention are those which have an average aspect ratio as defined in column 12 of U.S. Pat. No. 4,439,520 of at least 3, and preferably of from 4 to 8.

Furthermore, tabular grains can be obtained in an environment in which the pBr has a comparatively low value of 1.3 or less by forming see crystals which account for at least 40% of the weight and then growing the crystals by adding silver and halogen solutions simultaneously while maintaining the pBr value at the same level.

It is desirable that the silver and halogen solutions be added in such a way that no new crystal nuclei are formed during the course of grain growth.

The size of the tabular silver halide grains can be adjusted by controlling the temperature, selecting the type and amount of solvent, and controlling the rates of addition of the silver salt and the halide which are used during grain growth.

Moreover, from among the tabular silver halide grains, the use of monodispersed hexagonal tabular grains is especially desirable.

Details of the structure and method of manufacture of the monodispersed hexagonal tabular grains as referred to in this invention have been dissolved in JP-A No. 63-151618. But in simple terms, the preferred emulsions of the present invention are silver halide emulsions consisting of a dispersion medium and silver halide grains, and at least 70% of the total projected area of the silver halide grains is made up of tabular silver halide grains which have a hexagonal form of which the ratio of the length of the side of maximum length with respect to the length of the side of minimum length is not more than 2, and which have two parallel planes for the outer surfaces and, moreover, they are monodispersions in which the coefficient of variation of the grain size distribution of the hexagonal tabular silver halide grains (a value obtained by dividing the variation (standard deviation) of the grain size represented as the diameter of the projected area calculated as a circle by the average grain size) is not more than 20%, and the aspect ratio is at least 2.5 and the grain size is at least 0.2 μm.

The above-mentioned preferred hexagonal tabular grains may consist of silver bromide, silver iodobromide, silver chlorobromide or silver chloroiodobromide. When iodide ions are present, the iodide content is from 0 to 30 mol %, and the crystal structure may be uniform, or the inner and outer parts can have different halogen compositions and the grains may have a layer structure. Furthermore, the inclusion of reduction sensitized silver nuclei in the grains is desirable.

The above-mentioned silver halide grains can be manufactured by the process of nuclei formation, Ostwald ripening and grain growth; the details have been disclosed in JP-A No. 63-151618.

Furthermore, the silver halide grains used in the present invention may take the form of grains of the core/shell type in a shallow internal latent image type emulsion in which the above-mentioned hexagonal tabular grains are used for the cores. In such a case the chemical sensitization of the core, the attachment of the shell, and the development of the materials in a development bath that contains silver halide solvents can be achieved in the ways indicated in JP-A No. 59-133542 and in British Patent No. 145,876. In this case the thickness of the shell is from 1 to 100 lattices, and preferably from 5 to 50 lattices.

Furthermore, the silver halide grains which are used in the present invention may take the form of grains in which the above mentioned hexagonal tabular grains have been used as host grains on which guest grains of various halogen compositions have been grown epitaxially. The epitaxial growth of guest grains can be achieved with reference to JP-A Nos. 58-108562, 57-133540, and 62-32443.

The hexagonal tabular grains which are used in the present invention may have internal dislocation lines. By observation using a low temperature (liquid helium temperature) transmission type electron microscope, assessment can be made of: (i) whether or not dislocation lines are present, and (ii) the number of dislocation lines which are present.

Hexagonal tabular grains which have dislocation lines can be formed by adding iodide salt during the growth of the above-mentioned hexagonal tabular grains or by using the above-mentioned hexagonal tabular grains as seed crystals and adding iodide salt during the crystal growth period when further crystal growth is taking place. In this case, the period may be instantaneous (about half a second) or it may continue throughout the duration of the crystal growth period. The rate of addition of the iodide is such that the difference between the iodide content of the silver iodobromide precipitated as a result of the addition and the iodide content of the silver iodobromide of the substrate is at least 5 mol %.

Mixtures of two or more types of silver halide emulsion can be used for the light-sensitive silver halide emulsion in this invention. The emulsions which are mixed together may differ in grain size, halogen composition, speed, etc. For example, a light-sensitive silver halide emulsion consisting of spherical or potato shaped grains and a light-sensitive silver halide emulsion consisting of tabular grains of which the diameter is at least three times the thickness can be used in the same layer, or in different layers as described in JP-A No. 58-127921. When used in different layers, the light-sensitive silver halide emulsion consisting of tabular grains may be established on the side nearer to the support or on the side further away from the support.

The crystal structure of the silver halide grains may be uniform to the interior or it may have a layer like structure in which the interior and outer parts are different, or it may be of the so-called conversion type as described in British Patent No. 635,841 and U.S. Pat. No. 3,622,318. Furthermore, the silver halides of different composition may be joined with an epitaxial junction, or they may be joined with a compound other than silver thiocyanate or silver oxide. Moreover, from the latent image point of view they may be of the surface latent image type or of the internal latent image type, but grains in which the latent image is concentrated at specific sites (e.g., apices) on the surface are especially desirable.

Cadmium salts, zinc salts, lead salts, thallium salts, iridium salts or complex salts thereof, rhodium salts or complex salts thereof, or iron salts or complex salts thereof may also be present during the course of the grain formation or physical ripening of the silver halide grains when preparing the silver halide emulsion.

Furthermore, so-called silver halide solvents, such as ammonia, thioether compounds, thiazolidinethione, tetra-substituted thioureas etc., can also be present during grain formation.

The known methods such as sulfur sensitization, reduction sensitization, gold sensitization, etc., can be used for the chemical sensitization of the silver halide emulsions which are used in the present invention, and these methods can be used independently or in combination.

In the case of gold sensitization among the noble metal sensitization methods, gold compounds, principally gold complex salts, are typically used. Complex salts of noble metals other than gold, such as platinum, palladium, irridium, etc., can also be included. Typical examples have been described in U.S. Pat. No. 2,448,060 and in British Patent No. 618,061.

Various sulfur compounds, for example, thiosulfates, thioureas, thiazoles, rodanines, etc., can be used as sulfur sensitizing agents as well as the sulfur compounds which are contained in the gelatin.

Stannous salts, amines, formamidinesulfinic acid and silane compounds, etc. can be used as reduction sensitizing agents.

Various compounds can be included in the photographic emulsions used in the present invention with a view to preventing the occurrence of fogging during the manufacture, storage or photographic processing of the light-sensitive materials or with a view to stabilizing photographic performance. Thus, many compounds which are known as anti-fogging agents or stabilizers, such as azoles {for example, benzothiazolium salts, nitroimidazoles, nitrobenzimidazoles, chlorobenzimidazoles, bromobenzimidazoles, nitroindazoles, benzotriazoles, aminotriazoles, etc.}, mercapto compounds {for example, mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines, etc.}, thioketo compounds, such as, for example, oxazolinethione, azaindenes {for example, triazaindenes, tetraazaindenes (especially 4-hydroxy substituted (1,3,3a,7-)tetra-azaindenes), penta-azaindenes, etc.}, benzenethiosulfonic acid, benzenesulfinic acid, and benzenesulfonic acid amide etc. can be added for this purpose.

The use of the nitrones and derivatives thereof disclosed in JP-A Nos. 60-76743 and 60-87322, the mercapto compounds disclosed in JP-A No. 60-80839, the heterocyclic compounds disclosed in JP-A No. 57-164735, and heterocyclic complex silver salts (e.g., 1-phenyl-5-mercaptotetrazole silver complex salts) etc. is especially desirable.

Furthermore, the use of the combinations of tabular grains and hydroquinone derivatives described in Japanese Patent Application No. 62-228030 is desirable in the present invention.

The light-sensitive silver halide emulsions used for the photographic material of the present invention may or may not be spectrally sensitized to comparatively long wavelength blue light, green light, red light or infrared light by means of sensitizing dyes, but they are preferably sensitized in this way. The cyanine dyes, merocyanine dyes, complex cyanine dyes, complex merocyanine dyes, holopolar cyanine dyes, styryl dyes, hemicyanine dyes, oxonol dyes, and hemioxonol dyes, etc. can be used as sensitizing dyes.

Examples of useful sensitizing dyes which can be used in the present invention have been disclosed in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, in JP-A No. 48-76525, and in Belgian Patent No. 691,807, etc.

Here, the sensitizing dyes may be introduced during any of the processes during the manufacture of the photographic emulsion, and they can also be included at any stage after manufacture until immediately prior to coating. In the former case, the introduction can be made during the process in which the silver halide grains are being formed, during the physical ripening process or during the chemical ripening process, etc.

If adsorbing substances which are adsorbed competitively with the above-mentioned sensitizing dyes (different types of sensitizing dye, or the aforementioned stabilizers, anti-fogging agents, etc.) are used together with the sensitizing dyes, in proportions of $10^{-3}$ mol % to $10^{-1}$ mol %, with color sensitization, then the sensitizing effect is desirably enhanced.

Various surfactants can be included for a variety of purposes in the photographic emulsion layers or other hydrophilic colloid layers of light-sensitive materials which have been made using the present invention. For example, such surfactans can be added as coating promotors, as anti-static agents, for the improvement of sliding properties, for emulsification and dispersion purposes, for the prevention of sticking, and for the improvement of photographic performance (for example, for accelerating development, film hardening, increasing speed), etc.

For example, use can be made of non-ionic surfactants such as alkyl esters {e.g., saponin (steroid based), alkylene oxide derivatives (for example, poly(ethylene glycol), poly(ethyleneglycol)/poly(propylene glycol) condensates, poly(ethylene glycol) alkyl ethers or poly(ethylene glycol) alkyl aryl ethers, poly(ethylene oxide) adducts of silicones), etc.}; anionic surfactants such as alkyl sulfonates, alkylbenzenesulfonates, alkylnaphthalenesulfonates, alkyl sulfate esters, N-acyl-N-alkyl taurins, sulfosuccinate esters, sulfoalkylpolyoxyethylene alkylphenyl ethers, etc.; amophoteric surfactants such as alkyl betaines, alkylsulfonebetaines, etc.; and cationic surfactants such as aliphatic or aromatic quaternary ammonium salts, pyridinium salts, imidazolium salts, etc.

From among these surfactants, the use of saponin, anionic surfactants such as sodium dodecylbenzenesulfonate, sodium di-2-ethylhexyl-$\alpha$-sulfosuccinate, sodium p-octylphenoxyethoxyethoxyethanesulfonate, sodium dodecyl sulfate, sodium tri-isopropylnaphthalenesulfonate, sodium N-methyl-oleoyltaurinate, etc., cationic surfactants such as dodecyltrimethylammonium chloride, N-oleoyl-N',N',N'-trimethylammoniodiaminopropane bromide, dodecylpyridium chloride, etc., and nonionic surfactants such as the betaines, for example, N-dodecyl-N,N-dimethylcarboxybetaine, N-oleyl-N,N-dimethylsulfobutylbetaine, etc., and poly (average degree of polymerization n=10) oxyethylene cetylether, poly(n=25)oxyethylene p-nonylphenol ether, bis(1-poly(n=15)oxyethylene-2,4-di-tert-pentylphenyl)ethane, etc. are especially desirable.

Preferred antistatic agents for use in the present invention include fluorine-containing surfactants, such as potassium perfluorooctanesulfonate, sodium glycine N-propyl-N-perfluorooctanesulfonate, sodium N-propyl-N-perfluorooctanesulfonylaminoethyloxypoly(n=-3)oxyethylenebutanesulfonate, N-perfluorooctanesulfonyl-N',N',N'-trimethylammoniodiaminopropane chloride, N-perfluorodecanoylaminopropyl-N',N'-dimethyl-N'-carboxybetaine, etc., the non-ionic based surfactants disclosed in JP-A Nos. 60-80848, 61-112144, 62-172343, and 62-173459, etc., the alkali metal nitrates, electrically conductive tin oxide, zinc oxide, vanadium pentoxide and the complex oxides where these oxides have been doped with antimony as antistatic agents.

Fine particles of poly(methyl methacrylate) homopolymers or copolymers of methyl methacrylate and methacrylic acid, as disclosed in U.S. Pat. Nos. 2,992,101, 2,701,245, 4,142,894 and 4,396,706, organic compounds such as starch, or inorganic compounds such as silica, titanium dioxide, sulfuric acid, strontium, barium, etc. can be used as matting agents in the present invention. The particle size of these matting agents is from 1.0 to 10 μm, and preferably from 2 to 5 μm.

Paraffin wax, higher fatty acid esters and starch derivatives, as well as the silicone compounds disclosed in U.S. Pat. Nos. 3,489,576 and 4,047,958, etc. and the colloidal silica disclosed in JP-B No. 56-23139, can be used as lubricants in the surface layers of the photographic materials of the present invention.

Polyols, such as trimethylolpropane, pentanediol, butanediol, ethyleneglycol and glycerine, etc. can be used as plasticizers in the hydrophilic colloid layers of the photographic materials of the present invention.

Gelatin is useful as the binding agent or protective colloid which is used for the emulsion layers, intermediate layers and surface protective layers of the light-sensitive materials of the present invention, but other hydrophilic colloids can be used for this purpose. For example, gelatin derivatives, graft polymers of other polymers with gelatin, proteins such as albumin, casein, etc., cellulose derivatives such as hydroxyethylcellulose, carboxymethylcellulose, cellulose sulfate esters, etc., sodium alginate, dextran, sugar derivatives such as starch derivatives, and various synthetic hydrophilic polymeric materials such as homopolymers, for example, poly(vinyl alcohol), partially acetalated poly(vinyl alcohol), poly(Nvinylpyrrolidone), poly(acrylic acid), poly(methacrylic acid), polyacrylamide, polyvinylimidazole, polyvinylpyrazole, etc., or copolymers thereof, can be used as the above-mentioned binding agent or protective colloid.

Acid treated gelatins and enzyme treated gelatins can be used for the gelatin as well as lime treated gelatin, and hydrolyzates and enzyme decomposed gelatins can also be used for the above-mentioned purpose. Of these materials, the concurrent use of polyacrylamide or dextran of average molecular weight not more than 50,000 with gelatin is preferred.

Inorganic or organic film hardening agents may be included in the photographic emulsions and light-insensitive hydrophilic colloids of the present invention. For example, chromium salts (chrome alum, chromium acetate, etc.), aldehydes (formaldehyde, glyoxal, glutaraldehyde, etc.), N-methylol compounds (for example, dimethylolurea, methyloldimethylhydantoin, etc.), dioxane derivatives (2,3-dihydroxydioxane, etc.), active vinyl compounds (1,3,5-triacryloyl-hexahydro-striazine, bis(vinylsulfonyl)methyl ether, N,N'-methylenebis(β-(vinylsulfonyl)propionamide), etc.), active halogen compounds (2,4-dichloro-6-hydroxy-s-triazine, etc.), mucohalogenic acids (mucochloric acid, mucophenoxychloric acid, etc.), iso-oxazoles, dialdehyde starch, 2-chloro-6-hydroxytriazinalized gelatin, etc. can be used individually or in combination for these purposes. Of these materials, it is preferred to use the active vinyl compounds disclosed in JP-A Nos. 53-41221, 53-57257, 59-162546 and 60-80846, and the active halogen compounds disclosed in U.S. Pat. No. 3,325,287.

The hydrophilic colloid layers in the photographic materials of this invention are preferably hardened with these film hardening agents in such a way that the degree of swelling in water is less not more than 200%, and preferably not more than 150%.

There may be two or more silver halide emulsion layers, and the speeds and gradations, etc. of the two or more silver halide emulsion layers may be different.

The supports used in the present invention include a transparent support such as polyethylene terephthalate film or triacetyl cellulose film. Of these, a blue dyed polyethyleneterephthalate film having thickness of 100 μm to 200 μm is preferred.

The present invention is illustrated in practical terms below by means of examples, but is not to be construed as being limited thereto.

EXAMPLE 1

A first coating liquid of which the composition is indicated below was coated using a wire bar coater at the rate of 5.1 cc/m$^2$ on a biaxially extended polyethyleneterephthalate film which had a thickness of 175 μm and had been subjected to a coronal discharge treatment. Then, the coating was dried for 1 minute at 175° C. A first subbing layer was then established on the other side of the film in the same way.

| | |
|---|---|
| Butadiene/styrene copolymer latex solution* (solid fraction 40%, butadiene/styrene ratio (by weight) = 31/69) | 79 cc |
| 2,4-Dichloro-6-hydroxy-s-triazine, sodium salt, 4% solution | 20.5 cc |
| Distilled water | 900.5 cc |

$$^{*}\begin{array}{l} nC_6H_{13}OOCCH_2 \\ \quad\quad\quad | \\ nC_6H_{13}OOCCH{-}SO_3Na \end{array}$$

was included in the latex solution as an emulsification and dispersing agent at the rate of 0.4 wt % with respect to the solid fraction of the latex.

Coating liquids for second subbing layers (hereafter referred to as second coating liquids) were coated over the above-mentioned first subbing layer on both sides of the film at a rate of 8.5 cc/m$^2$. Then, the undercoated films were dried. The compositions used to form these second coating liquids are indicated below:

Second Coating Liquid-1

| | |
|---|---|
| Gelatin | 10 g |
| Polymer Latex solution of solid fraction 20% | 30 cc |
| 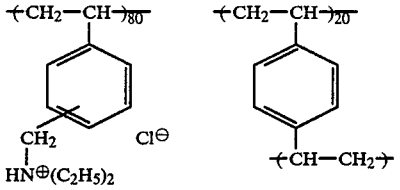 | |
| Matting agent, poly(methyl methacrylate) of average particle size 2.5 μm | 0.3 g |
| 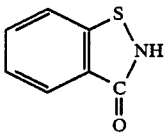 | 0.035 g |

Water was added to the composition indicated above to produce a total volume of 1 liter.

Second Coating Liquid-2

The compound indicated below was added to the second coating liquid-1:

| | |
|---|---|
| 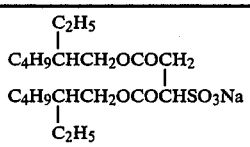 | 0.2 g |

Second Coating Liquid-3

The compounds indicated below were added to the second coating liquid-1:

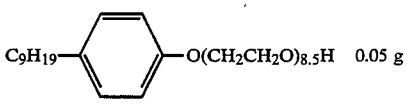 0.05 g

Second Coating Liquid-4

| | |
|---|---|
| same as Liquid 3 above | 0.1 g |

Second Coating Liquid-5

| | |
|---|---|
| Same as Liquid 3 above | 0.2 g |

Second Coating Liquid-6

| | |
|---|---|
| Same as Liquid 3 above | 0.5 g |

Second Coating Liquid-7

| | |
|---|---|
| The compound indicated below was added to the second coating liquid-1: $C_{12}H_{25}(CH_2CH_2O)_{10}H$ | 0.2 g |

Second Coating Liquid-8

| | |
|---|---|
| The compound indicated below was added to the second coating liquid-5: Methylcellulose ("Metrose SM15", made by the Shin-etsu Chemical Co.) degree of substitution 1.8 | 0.2 g |

Second Coating Liquid-9

| | |
|---|---|
| The compound incidated below was added to the second coating liquid-7: Methylcellulose ("Metrose SM15", made by the Shin-etsu Chemical Co.) degree of substitution 1.8 | 0.2 g |

Second Coating Liquid-10

| | |
|---|---|
| The compound indicated below was added to the second coating liquid-8: $C_{11}H_{23}CONHCH_2CH_2CHN^+(CH_3)_2COO^-$ | 0.2 g |

The subbing layer surface condition Of the undercoated supports obtained in this way was evaluated by dying with brilliant blue. The assessment was made visually, the result being classified as 0 when there was no problem at all with undercoating unevenness, as X when the unevenness was of such a degree as to be completely impractical, and with three intermediate levels, namely: OΔ, Δ and ΔX, between these extremes. The unevenness of the subbing considered here was ladder and streak unevenness, and those evaluated as being OΔ or better were of such a level as to be useful in practice. On the other hand, in the case of marbling, the number of defective sites per square meter was counted. Needless to say, in this case the lower the number the better the result. The results of the evaluations are shown in Table 1.

TABLE 1

| Support No. | Second Coating Liquid | Subbing Unevenness (step, streak) | Marbling (Number per square meter) |
|---|---|---|---|
| A | 1 (Comparison) | X | 45 |
| B | 2 (Comparison) | X | 25 |
| C | 3 (This Invention) | Δ | 15 |
| D | 4 (This Invention) | OΔ | 10 |
| E | 5 (This Invention) | OΔ | 3 |
| F | 6 (This Invention) | O | 0 |
| G | 7 (This Invention) | OΔ | 2 |
| H | 8 (This Invention) | O | 0 |
| I | 9 (This Invention) | O | 0 |
| J | 10 (This Invention) | O | 0 |

The effectiveness of the invention is clear from the results shown in Table 1.

EXAMPLE 2

A potato like silver iodobromide emulsion of average grain size 0.6μm which contained 1.4 mol % of silver iodide was prepared using ammonia. This emulsion was chemically sensitized with the addition of 3 mg of chloroauric acid per mol of silver and 10 mg of sodium thiosulfate per mol of silver, after which 70 mg per mol of silver of 4-hydroxy-6-methyl-1,3,3a,7-tetraazaindene was added as an anti-fogging agent.

On the other hand, an aqueous gelatin solution which contained, as well as gelatin, sodium polystyrenesulfonate, fine poly(methyl methacrylate) particles (average particle size 3.0 μm), polyethyleneoxide and dextran of average molecular weight 20,000 at a rate of 30 wt % with respect to the gelatin was prepared for a surface protective layer. Acid treated gelatin was used in this case. 1,2-bis(sulfonylacetamido)ethane was added at the rate of 4 mmol/100 grams of gelatin as a film hardening agent at the time of coating.

Photographic material 1 was prepared by (i) coating the emulsion layer and the surface protective layer at the same time onto the same support as Support B of Example 1 except that the polymer latex had been omitted from the formulation, and (ii) drying the layers. The coated silver weight was 8.0 g/m$^2$ per side, and both sides of the support were coated.

Photographic material 2 was prepared in the same way by coating and drying on the same support as Support H of Example 1. Next, photographic material 3 was prepared by coating and drying the emulsion layer in the same way as for photographic material 1; but after increasing the amount of polymer latex solution in the second coating liquid-9 in Example 1 was coated to 60 cc as a subbing layer.

Evaluation of the Fixing Time

The time required for complete fixing in the fixing bath indicated below was measured in each case. The fixing bath temperature was 25° C.

| Fixing Bath | |
|---|---|
| Ammonium thiosulfate | 200 g |
| Sodium sulfite (anhydrous) | 20 g |
| Boric acid | 8 g |
| Ethylenediamine tetra-acetic acid, di-sodium salt | 0.1 g |
| Ammonium nitrate | 15 g |
| Sulfuric acid | 2 g |
| Glacial acetic acid | 22 g |
| Water | to make up to 5.0 liters (pH adjusted to 4.30) |

Results

| Photographic Material | Time for Complete Fixing |
|---|---|
| 1 (Comparison) | 28 seconds |
| 2 (This Invention) | 22 seconds |
| 3 (This Invention) | 18 seconds |

It is clear from the results indicated above that the present invention provides a marked shortening of the required fixing time.

EXAMPLE 3

Preparation of Silver Halide Photographic Material-4 of this Invention

A blue dyed transparent support consisting of polyethyleneterephthalate of thickness 175 μm which had been coated with a first subbing layer was prepared in the same way as in Example 1. The liquids (A) and (B) indicated below were prepared and the two liquids were mixed together after forming two uniform solutions to provide a coating liquid for a second subbing layer.

Liquid (A)

| | |
|---|---|
| Gelatin | 8 g |
| Polymer latex solution (shown below), solid fraction 20% | 31 cc |

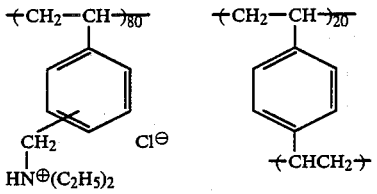

Dyes

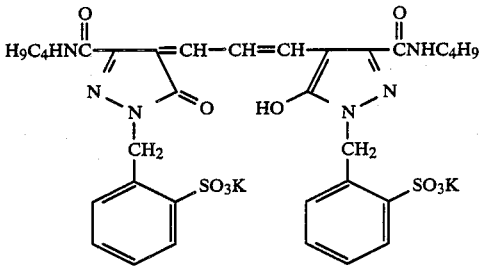

63 cc as a 3% solution

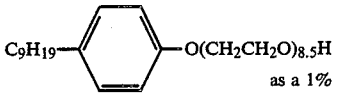

20 cc as a 1% solution

| | |
|---|---|
| Methylcellulose ("Metrose SM15", made by the Shin-etsu Chemical Co.) | 0.2 g |
| Water | 567 cc |

Liquid (B)

| | |
|---|---|
| Gelatin | 2 g |
| Matting agent, Poly(methyl methacrylate), (average particle size 2.5 μm) | 0.3 g |

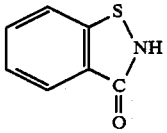

1 cc 3.5% solution

| | |
|---|---|
| Water | 308 cc |

The mixture of Liquids (A) and (B) was coated on both sides at the rate of 8.5 cc/m$^2$ per side and both sides were dried.

Preparation of the Emulsion Layer Coating Liquid

Five grams of potassium bromide, 0.05 gram of potassium iodide, 30 grams of gelatin and 2.5 cc of a 5% aqueous solution of the thioether $HO(CH_2)_2S(CH_2)_2S(CH_2)_2OH$ were added to 1 liter of water, and the solution obtained was maintained at a temperature of 75° C. Next, an aqueous solution of 8.33 grams of silver nitrate and an aqueous solution which contained (i) 5.94 grams of potassium bromide and (ii) 0.726 gram of potassium iodide were added to the stirred solution over a period of 45 seconds using the double jet method. Then, after adding 2.5 grams of potassium bromide, an aqueous solution which contained 8.33 grams of silver nitrate was added over a period of 7 minutes 30 seconds, the addition being made in such a way that the flow rate at the end of the addition was double that at the start of the addition.

Next, an aqueous solution of 153.34 grams of silver nitrate and a 20 wt % aqueous solution of potassium bromide were added over a period of 25 minutes using the controlled double jet method while maintaining the potential at pAg 8.1. The flow rate at this time was accelerated so that the flow rate at the end of the addition was eight times that at the start of the addition. After the addition had been completed, 15 cc of a potassium thiocyanate solution (2N) was added. Further, a 1% aqueous solution of potassium iodide was added over a period of 30 seconds. The temperature was subsequently reduced to 35° C. and, after removing the soluble salts using the sedimentation (flocculation) method, the temperature was raised again to 40° C. whereupon 68 grams of gelatin, 2 grams of phenol and 7.5 grams of trimethylolpropane were added and the pH was adjusted to 6.55 with caustic soda and the pAg was adjusted to 8.10 with potassium bromide.

The temperature was then raised to 56° C. and 735 mg of a sensitizing dye of which the structure is indicated below was added. After 10 minutes, 5.5 mg of sodium thiosulfate pentahydrate, 163 mg of potassium thiocyanate and 3.6 mg of chloroauric acid were added and the mixture was cooled rapidly and set after 5 minutes. The emulsion thus obtained was such that grains which had an aspect ratio of at least 3 accounted for 93% of the total projected area of all the grains, and the average projected area diameter of the grains (which were all of aspect ratio of at least 2) was 0.83 μm, standard deviation 18.5%. The average thickness of the grains wa 0.161 μm and the aspect ratio was 5.16.

Sensitizing Dye

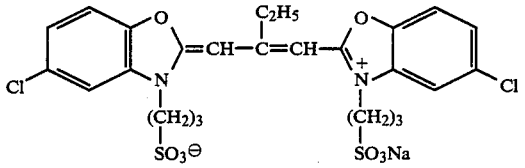

The chemicals indicated below were added to this emulsion at the rates indicated per mol of silver halide to form a coating liquid.

| | |
|---|---|
| 4-Hydroxy-6-methyl-1,3,3a,7-tetra-azaindene | 1.94 g |
| 2,6-Bis(hydroxyamino)-4-diethylamino-1,3,5-triazine | 80 mg |
| Poly(sodium acrylate) (average molecular weight 41,000) | 4.0 g |
| 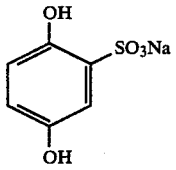 | 9.7 g |
| Copolymer plasticizer of Ethyl acrylate/acrylic acid/ methacrylic acid = 95/2/3 (by mol) | 20.0 g |

-continued

| | |
|---|---|
| Nitrone | 50 mg |
| 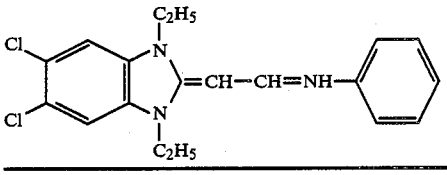 | 5.0 mg |

The emulsion layer coating liquid thus obtained was coated onto both sides of the aforementioned support along with a surface protective layer liquid using a simultaneous extrusion system. As this time, the coated weights of the emulsion layer and the surface protective layer per surface were as indicated below:

| | |
|---|---|
| Emulsion Layer: | |
| Coated silver weight | 1.9 g/m$^2$ |
| Coated gelatin weight | 1.5 g/m$^2$ |
| Surface Protective Layer: | |
| Gelatin | 0.81 g/m$^2$ |
| Dextran (average molecular weight 39,000) | 0.81 g/m$^2$ |
| Matting agent; Poly(methyl methacrylate)/ methacrylic acid = 9/1 copolymer, average particle size 3.5 μm) | 0.06 g/m$^2$ |
| $C_8H_{17}$—$C_6H_4$—$O(CH_2CH_2O)_{10}(CH_2CH(OH)CH_2O)_3H$ | 60 mg/m$^2$ |
| $C_8H_{17}$—$C_6H_4$—$O(CH_2CH_2O)_2CH_2CH_2SO_3Na$ | 20 mg/m$^2$ |
| $C_8F_{17}SO_2N(C_3H_7)(CH_2CH_2O)_4(CH_2)_4SO_3Na$ | 2 mg/m$^2$ |
| $C_8F_{17}SO_2N(C_3H_7)(CH_2CH_2O)_{15}H$ | 5 mg/m$^2$ |
| Poly(sodium acrylate) (average molecular weight 41,000) | 70 mg/m$^2$ |

1,2-Bis(sulfonylacetamido)ethane was coated at a rate of 127 mg/m$^2$ per side as a film hardening agent. Photographic material 4 of this invention was obtained in this way.

Preparation of Comparative Photographic Material 5

Photographic material 5 was prepared using a support which had been coated with the second coating liquid-2 in Table 1 of Example 1 instead of the support used for photographic material 4.

Preparation of Comparative Photographic Material 6

An intermediate layer of which the details are given below was coated using the simultaneous extrusion method (surface protective layer/emulsion layer/intermediate layer) between the emulsion layer and the subbing layer of photographic material 5.

| | |
|---|---|
| Intermediate Layer (per side) | |
| Gelatin | 0.8 g/m$^2$ |

-continued

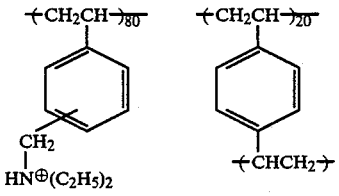

52.7 mg/m²

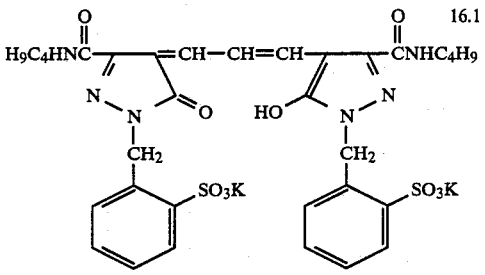

16.1 mg/m²

Methylcellulose ("Metrose SM15" made by the Shinetsu Chemical Co.) 1.7 mg/m²

Preparation of Comparative Photographic Material 7

The polymer latex and dye used in the coating layer liquid (A) of photographic material 4 of the present invention were changed to those indicated below.

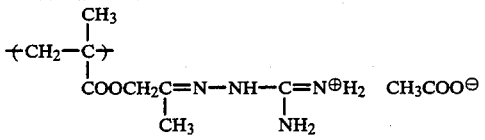

31 cc

20% solution

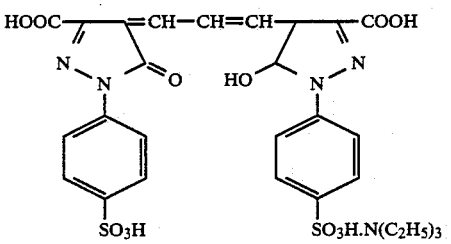

63 cc

3% solution

The photographic material 7 was then prepared in the same way as photographic material 4.

Evaluation of Photographic Performance

Photographic materials 4 to 7 were adhered on both sides with Fuji Photo Film Co., Ltd. GRENEX orthoscreen G-4 using a cassette, and then they were subjected to X-ray sensitometry. Exposure control was achieved by varying the distance between the X-ray tube and the cassette. After exposure, the materials were processed in an automatic developing machine using the development and fixing baths indicated below. The sensitivity was indicated as a relative value in each case, taking that of the photographic material 4 to be 100.

Development Bath Concentrate

-continued

| | |
|---|---|
| Potassium hydroxide | 56.6 g |
| Sodium sulfite | 200 g |
| Diethylenetriamine penta-acetic acid | 6.7 g |
| Potassium carbonate | 16.7 g |
| Boric acid | 10 g |
| Hydroquinone | 83.3 g |
| Diethyleneglycol | 40 g |
| 4-Hydroxymethyl-4-methyl-1-phenyl-3-pyrazolidone | 11.0 g |
| 5-Methylbenzotriazole | 2 g |
| Water | to make up to 1 liter (pH adjusted to 10.60) |

Fixing Bath Concentrate

| | |
|---|---|
| Ammonium thiosulfate | 560 g |
| Sodium sulfite | 60 g |
| Ethylenediamine tetra-acetic acid, disodium salt dihydrate | 0.10 g |
| Sodium hydroxide | 24 g |
| Water | to make up to 1 liter (pH adjusted to 5.10 with acetic acid) |

| Automatic Developing Machine | | Processing |
|---|---|---|
| Development Tank | 6.5 liters | 35° C. × 12.5 sec. |
| Fixing Tank | 6.5 liters | 35° C. × 10 sec. |
| Water Wash Tank | 65. liters | 20° C. × 7.5 sec. |
| Drying | | 50° C. |
| Dry to dry processing time | | 48 seconds |

At the start of development processing the processing baths were supplied to each tank as indicated below.

Development Tank:

The above-mentioned development bath concentrates (333 ml) and 667 ml of water, to which 10 ml of a starter which contained 2 grams of potassium bromide and 1.8 grams of acetic acid were added, the pH being set at 10.15.

Fixing Tank:

The above-mentioned fixing bath concentrate (250 ml) and 750 ml of water.

Evaluation of Drying Properties

After passing through the processes of development, fixing, washing and being squeegeed in the aforementioned automatic development processor treatment, film was removed immediately before entering the drying zone. The measurements indicated below were made.

The films, which had been removed, were blown in a commercial hot blow drier and the time taken for the surface temperature to reach 30° C. was measured. Temperature was measured with a surface thermometer. The development temperature was 35° C. and the water washing temperature was 14° C.

Measurement of Sharpness (MTF)

The MTF was measured using the aforementioned combination of G-4 screen and the automatic development processor treatment. Measurements were made with a 30 μm×500 μm aperture and the evaluation was made in a part of optical density 1.0 using an MTF value of spatial frequency 1.0 cycle/mm.

Measurement of Residual Coloration

Unexposed film was passed through the aforementioned development processing, and the green transmission density was measured through a Macbeth Status A filter. Then, the green transmission density of a blue dyed polyethyleneterephthalate support which had not been undercoated was measured; the net value obtained by subtracting this value was used to evaluate the residual color density.

The results obtained are summarized in Table 2.

TABLE 2

| Photographic Material | Relative Sensitivity | Drying Property | MTF | Residual Color |
|---|---|---|---|---|
| 4 (This Invention) | 100 | 23 sec. | 0.85 | 0.07 |
| 5 (Comparison) | 105 | 23 sec. | 0.73 | 0.04 |
| 6 (Comparison) | 90 | 28 sec. | 0.85 | 0.08 |
| 7 (Comparison) | 95 | 24 sec. | 0.85 | 0.13 |

It is clear from Table 2 that this invention provides a high degree of sharpness even in ultra-rapid processing with a dry to dry time of 48 seconds, and that it provides excellent results in connection with residual coloration and drying properties. Moreover, adhesion failure occurred with comparative photographic material 7 with some peeling between the emulsion layer and the support at the processing.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having thereon at least one silver halide emulsion layer and a subbing layer arranged between the support and said at least one silver halide emulsion layer containing an aqueous polymer latex represented by the following formula (I), which has a cross linked structure:

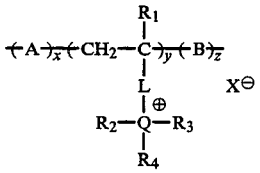

(I)

wherein A represents an ethylenic unsaturated monomer unit; $R_1$ represents a hydrogen atom or a lower alkyl group having from 1 to 6 carbon atoms; L represents a divalent group having from 1 to 12 carbon atoms; $R_2$, $R_3$ and $R_4$, which may be the same or different, each represents an alkyl group, an aralkyl group or a hydrogen atom; Q represents nitrogen or phosphorus; $X^{\ominus}$ represents an anion other than iodine ion; and B represents a structural unit in which copolymerizable monomers having at least two ethylenic unsaturated groups have been copolymerized; x is selected to constitute from 0 to 90 mol %; y is selected to constitute from 10 to 99.9 mol %; z is selected to constitute from 1.0 to 50 mol %; and $R_2$, $R_3$ and $R_4$ may be linked together to form, together with Q, a cyclic structure;

and wherein said subbing layer comprises a coating liquid containing a nonionic surfactant in an amount of at least 0.05 gram per liter.

2. A silver halide photographic material as in claim 1, wherein A is selected from the group consisting of a styrene and a methacrylic acid ester.

3. A silver halide photographic material as in claim 1, wherein $R_1$ represents a hydrogen atom or a methyl group.

4. A silver halide photographic material as in claim 1, wherein L is selected from the group consisting of

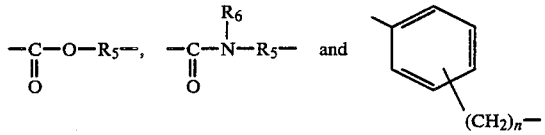

wherein $R_5$ represents an alkylene group, an arylene group or an aralkylene group; $R_6$ represents a hydrogen atom, an alkyl group having 1 to 20 carbon atoms, or an aralkyl group having 7 to 20 carbon atoms; and n is 1 or 2.

5. A silver halide photographic material as in claim 4, wherein L is

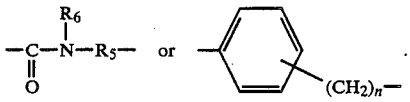

6. A silver halide photographic material as in claim 5, wherein L is

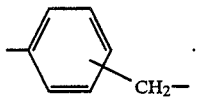

7. A silver halide photographic material as in claim 1, wherein $R_2$, $R_3$ and $R_4$ each represents an alkyl group which has from 1 to 20 carbon atoms, an aralkyl group which has from 7 to 20 carbon atoms or a hydrogen atom.

8. A silver halide photographic material as in claim 7, wherein only one of $R_2$, $R_3$, and $R_4$ is a hydrogen atom.

9. A silver halide photographic material as in claim 8, wherein $R_2$, $R_3$ and $R_4$ each represents an alkyl group which has from 1 to 12 carbon atoms, or an aralkyl group which has from 7 to 14 carbon atoms.

10. A silver halide photographic material as in claim 1, wherein Q is a nitrogen atom.

11. A silver halide photographic material as in claim 1, wherein $X^{\ominus}$ is selected from the group consisting of a chlorine ion, an alkylsulfate ion, an arylsulfonate ion, and a sulfate ion.

12. A silver halide photographic material as in claim 1, wherein y is selected to constitute from 10 to 95 mol %.

13. A silver halide photographic material as in claim 1, wherein z is selected to constitute from 1 to 30 mol %.

14. A silver halide photographic material as in claim 1, wherein said aqueous polymer latex is contained in an amount of from 5 to 300 mg/m$^2$ of the subbing layer.

15. A silver halide photographic material as in claim 14, wherein said aqueous polymer latex is contained in an amount of from 10 to 100 mg/m$^2$ of the subbing layer.

16. A silver halide photographic material as in claim 1, wherein said nonionic surfactant is contained in an amount of from 0.05 to 10 g per liter of the coating liquid.

17. A silver halide photographic material as in claim 16, wherein said nonionic surfactant is contained in an amount of from 0.05 to 1 g per liter of the coating liquid.

18. A silver halide photographic material as in claim 1, wherein said nonionic surfactant is present in said subbing layer in an amount of from 0.1 to 50 mg/m$^2$ of the subbing layer.

19. A silver halide photographic material as in claim 18, wherein said nonionic surfactant is present in said subbing layer in an amount of from 0.5 to 20 mg/m$^2$ of the subbing layer.

20. A silver halide photographic material as in claim 1, wherein z is selected to constitute from 1.0 to 30 mol %.

* * * * *